US006920772B1

(12) United States Patent
Shore et al.

(10) Patent No.: US 6,920,772 B1
(45) Date of Patent: Jul. 26, 2005

(54) PINCH ROLL UNIT

(75) Inventors: T. Michael Shore, Princeton, MA (US); Paul B. Riches, Paxton, MA (US); Yun Ling, Worcester, MA (US); Melicher Puchovsky, Dudley, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 10/365,589

(22) Filed: Feb. 12, 2003

(51) Int. Cl.[7] ..... B21B 31/22
(52) U.S. Cl. ..... 72/12.5; 72/248; 226/177
(58) Field of Search ..... 72/248, 250, 251, 72/8.8, 10.7, 12.5, 12.7; 226/176, 177, 181

(56) References Cited

U.S. PATENT DOCUMENTS

| | | | | |
|---|---|---|---|---|
| 3,014,628 A | * | 12/1961 | Littlehale | 226/177 |
| 3,543,555 A | | 12/1970 | Baumann et al. | 72/224 |
| 3,628,594 A | | 12/1971 | Reinfeld et al. | 164/417 |
| 3,700,379 A | * | 10/1972 | Robertson | 318/561 |
| 3,776,014 A | | 12/1973 | Artz et al. | 164/417 |
| 4,156,453 A | | 5/1979 | Scheinecker | 164/448 |
| 4,280,552 A | | 7/1981 | Bayer et al. | 164/448 |
| 4,283,930 A | | 8/1981 | Hasegawa et al. | 72/8.9 |
| 4,388,816 A | | 6/1983 | Ferket et al. | 72/11.5 |
| 4,413,494 A | * | 11/1983 | Gilvar et al. | 72/167 |
| 4,559,990 A | | 12/1985 | Greilinger et al. | 164/428 |
| 4,635,861 A | | 1/1987 | Resch | 241/37 |

* cited by examiner

*Primary Examiner*—Lowell A. Larson
(74) *Attorney, Agent, or Firm*—Gauthier & Connors, LLP

(57) ABSTRACT

A pinch roll unit for either propelling or retarding a product moving along the pass line of a rolling mill comprises a pair of levers mounted for rotation about parallel first axes. Roll shafts are carried by the levers with each roll shaft being journalled for rotation about a second axis parallel to the first axis of its respective lever. Pinch rolls are carried by the roll shafts and are positioned to define a gap therebetween for receiving the product. An electrically powered first motor operates via a linkage to rotate the levers about the first axes and to move the pinch rolls between open positions spaced from the product, and closed positions contacting and gripping the product therebetween. An electrically powered second motor rotatably drives the pinch rolls.

10 Claims, 4 Drawing Sheets

PINCH ROLL UNIT

BACKGROUND OF THE INVENTION

1. Field of the Invention

This invention relates generally to hot rolling mills of the type producing bar and rod products, and is concerned in particular with improvements in the pinch roll units and associated controls employed to propel and/or retard the movement of such products at various places along the mill pass line.

2. The Prior Art

Pinch roll units are conventionally employed in rod mills to propel smaller diameter products through water boxes, and to propel larger diameter products through the laying heads. Alternatively, pinch roll units can be employed to retard and brake the movement of bar products being directed to cooling beds, and to prevent the tail ends of rod products from accelerating after they leave the last mill stand and before they arrive at the laying heads.

Pinch roll closure must be precisely timed to achieve the desired function, and the pinching force and torque exerted by the pinch rolls must be carefully controlled and coordinated to avoid marking the product. Marking can result from excessive pinching force, or by an imbalance of pinching force and driving torque resulting in slippage of the rolls against the product surface.

Conventional pinch roll units employ electric motors to drive the pinch rolls, and pneumatically driven linear actuators to open and close the pinch rolls. The latter have proven to be problematical due to fluctuations in the pressure of compressed air normally available in rolling mills, and the relatively slow reaction times attributable largely to solenoid valve dead times, cylinder closing times, and the stroke distance of the pistons. Such problems are particularly acute in high speed rolling environments, e.g., in rod mills where product delivery speeds now routinely exceed 100 m/sec.

The principal objective of the present invention is to eliminate or at least significantly minimize the above described problems by replacing the conventional pneumatically driven linear actuators with more reliable faster acting electrically driven closure mechanisms.

SUMMARY OF THE INVENTION

A pinch roll unit in accordance with the present invention operates either to propel or retard a product moving along the pass line of a rolling mill. The pinch roll unit includes a pair of levers mounted for rotation about parallel first axes. Roll shafts are carried by the levers. Each roll shaft is journalled for rotation about a second axis parallel to the first axis of its respective lever. Pinch rolls are carried by the roll shafts, and are spaced one from the other to define a gap for receiving the product being processed by the mill.

An electrically powered first motor is operable via intermediate linkage to rotate the levers in opposite directions about their first axes, and to thereby adjust the pinch rolls between open positions spaced from the product, and closed positions contacting and gripping the product therebetween. An electrically powered second motor rotatably drives the pinch rolls.

Advantageously, the first motor is a servo motor driving a disc crank for rotation about a third axis parallel to the first and second axes, with link members mechanically connecting the disc crank to the levers carrying the roll shafts.

Preferably, the pinch roll unit operates in conjunction with a detector, e.g., a hot metal detector, which generates a signal indicative of the presence of the product at a location along the pass line preceding the gap defined by the pinch rolls. A control system operates in response to the detector signal to operate the first motor precisely and to adjust the pinch rolls between their open and closed positions. The control system is also preferably operable to control the pressure exerted by the pinch rolls on the product. Advantageously, this pressure control is achieved by varying the torque exerted by the first motor.

These and other features and advantages of the present invention will now be described in greater detail with reference to the accompanying drawings, wherein:

DETAILED DESCRIPTION OF PREFERRED EMBODIMENT

Figure 1:
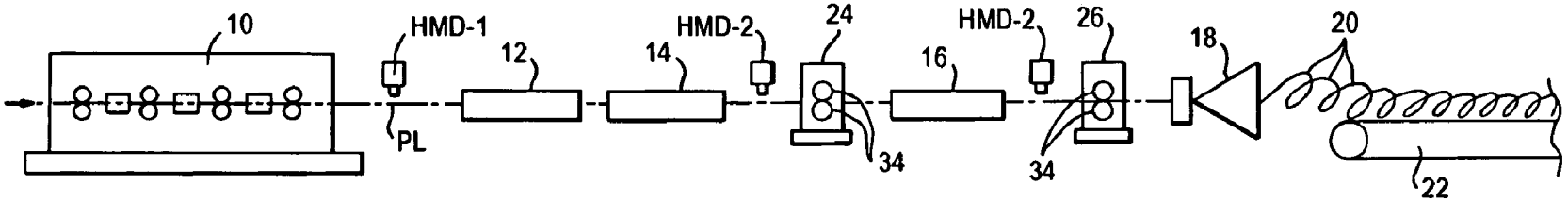
FIG. 1 is a schematic depiction of the delivery end of a rod mill equipped with pinch roll units in accordance with the present invention.

With reference initially to FIG. 1, an exemplary delivery end of a high speed rod mill is shown comprising a finishing block 10 of the type disclosed, for example, in U.S. Pat. No. Re. 28, 107. The hot rolled rod is propelled from the finishing block along the mill pass line PL at speeds typically exceeding 100 m/sec. The rod is cooled sequentially in water boxes, 12, 14 and 16 before being directed to a laying head 18. The laying head forms the rod into a continuous series of rings 20 which are deposited in an offset pattern on a cooling conveyor 22. The cooling conveyor delivers the rings to a reforming station (not shown) for collection into coils.

Pinch roll units 24 and 26 in accordance with the present invention are positioned along the mill pass line PL. Pinch roll unit 24 serves mainly in a driving mode to propel the product forwardly and to insure its passage through the last water box 16. Pinch roll unit 26 operates in either a breaking mode to slow the tail ends of smaller diameter products, which exhibit a tendency to speed up after they leave the finishing block 10, in a driving mode to push larger diameter slower moving products through the laying head 18.

Figure 2:
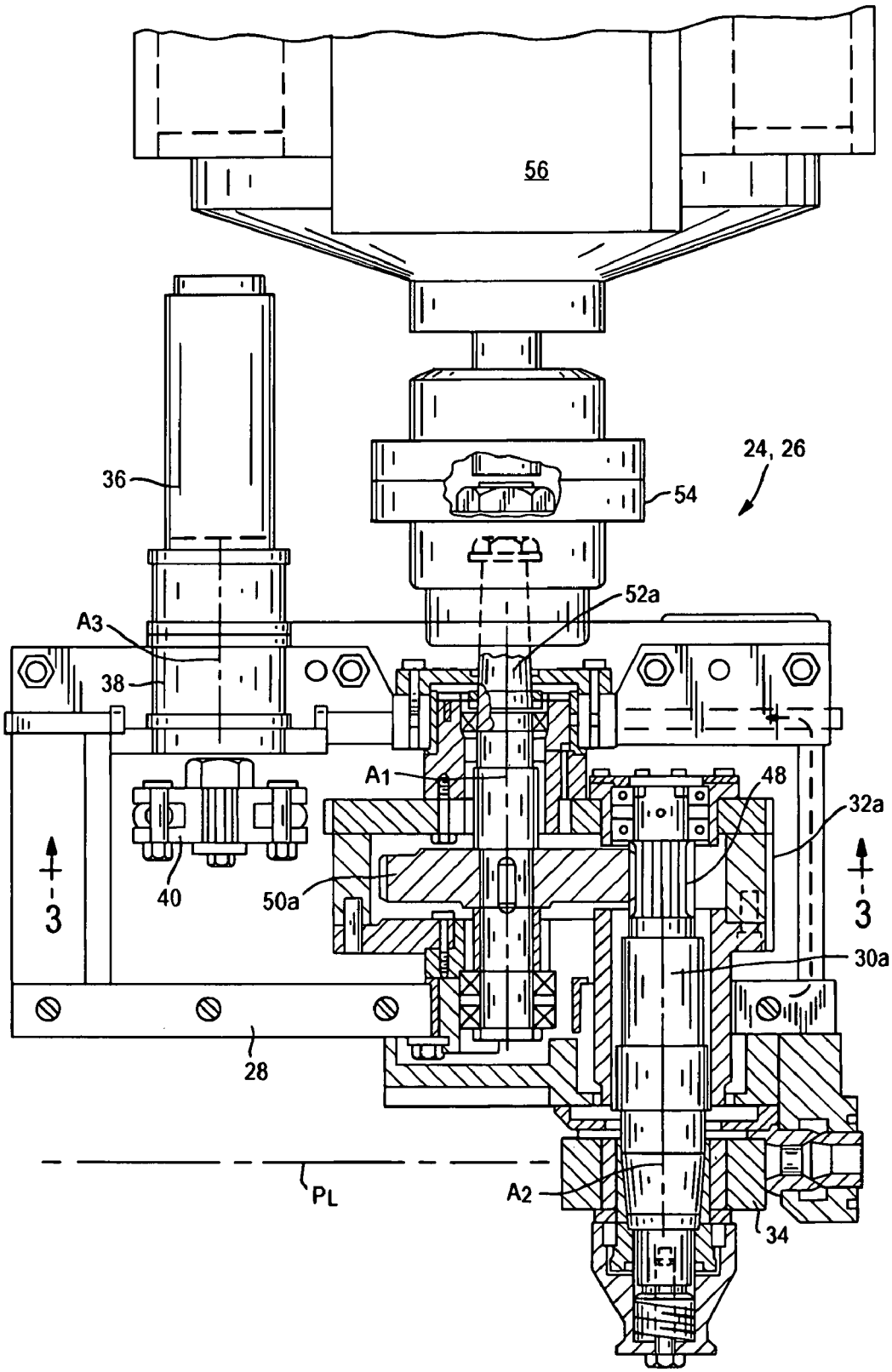
FIG. 2 is a horizontal sectional view taken through one of the pinch roll units shown in FIG. 1.
Figure 3:
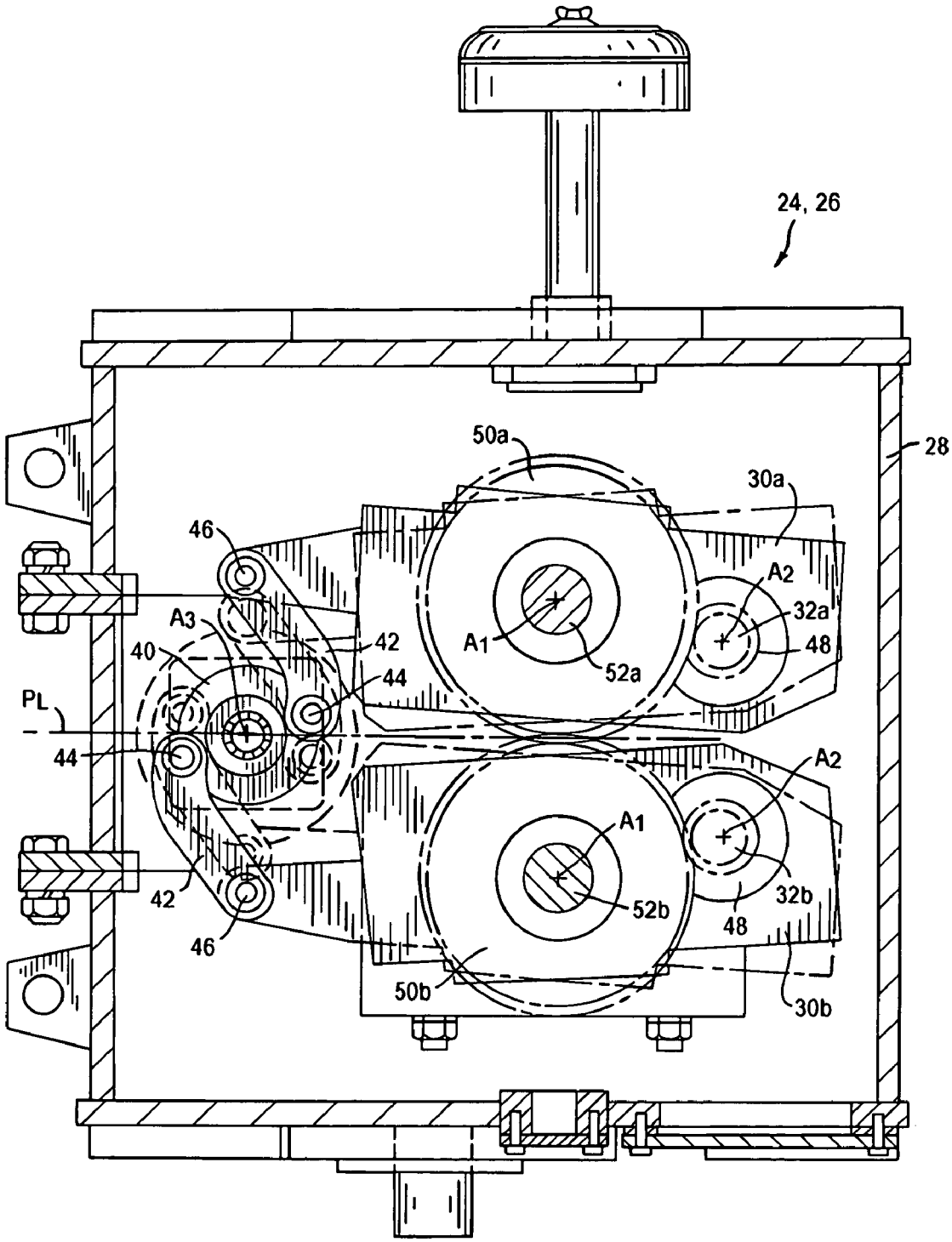
FIG. 3 is a vertical sectional view taken along line 3—3 of FIG. 2.

With reference additionally to FIGS. 2 and 3, it will be seen that pinch roll units 24, 26 in accordance with the present invention each include a housing 28 in which a pair of levers 30*a*, 30*b* are mounted for rotation about parallel first axes $A_1$. Roll shafts 32*a*, 32*b* are carried by the levers 30*a*, 30*b*, with each roll shaft being journalled for rotation about a second axis $A_2$ parallel to the first axis $A_1$ of its respective lever. Pinch rolls 34 are carried by the roll shafts and are spaced one from the other to define a gap therebetween for receiving a product moving along the mill pass line PL.

An electrically powered first motor 36 operates via a planetary gear unit 38 to rotate a disc crank 40 about a third axis $A_3$ parallel to the first and second axes $A_1$, $A_2$. Link members 42 are pivotally connected at opposite ends as at 44 to the disc crank 40 and as at 46 respectively to ears projecting from the levers 30*a*, 30*b*.

The disc crank 40 and link members 42 serve as a linkage for mechanically coupling the motor 36 and its gear unit 38 to the levers 30*a*, 30*b*, with the motor being operable via that linkage to rotate the levers about their respective first axes $A_1$ and to thereby adjust the pinch rolls 34 between open positions spaced from a product moving along the mill pass line, and closed positions contacting and gripping the product.

The roll shafts 32*a*, 32*b* are provided with toothed segments 48 meshing with intermeshed drive gears 50*a*, 50*b* carried on drive shafts 52*a*, 52*b*. Drive shaft 52*a* is coupled as at 54 to an electrically powered second motor 56. Motor 56 serves as the means for driving the pinch rolls 34.

Figure 4:
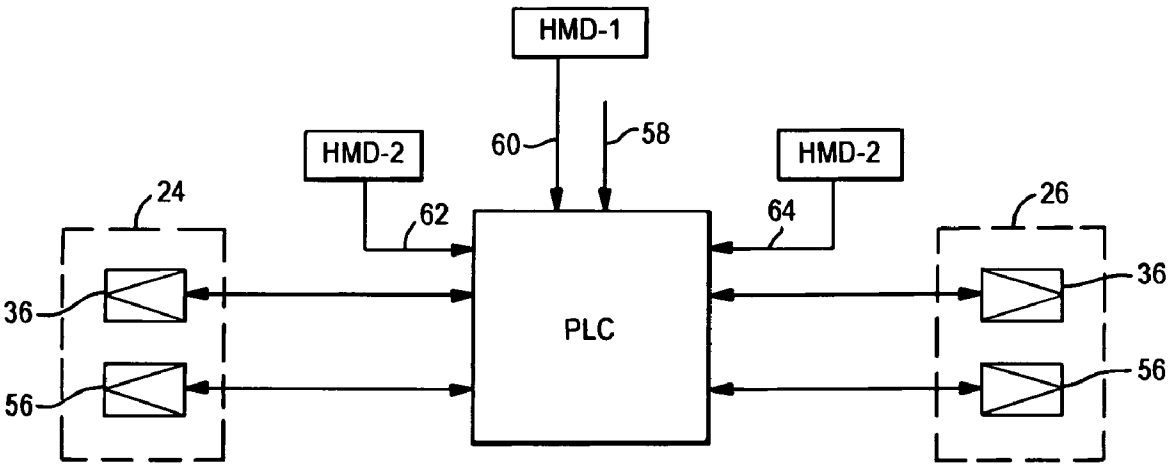
FIG. 4 is a schematic diagram of the system for controlling the pinching sequence of each pinch roll unit.

With reference additionally to FIG. 4, it will be seen that the first and second motors 36, 56 of the pinch roll units 24, 26 are controlled by a programmable logic controller (PLC) which operates in response to a product speed signal 58 generated by the mill control system, and by control signals 60, 62, 64 respectively generated by a hot metal detector (HMD-1) at the exit end of the finishing block 10, and by hot metal detectors (HMD-2) immediately preceding the pinch roll units 24, 26. The signal 58 representative of product speed enables the PLC to determine the time of product travel from one location to the next along the pass line, e.g., between a hot metal detector and its associated pinch roll unit. Changes in product speed are also indicative of changes in the size of the product being rolled.

The signals generated by the hot metal detectors are indicative of the passage of front and tail ends at their respective locations along the pass line.

Figure 5:
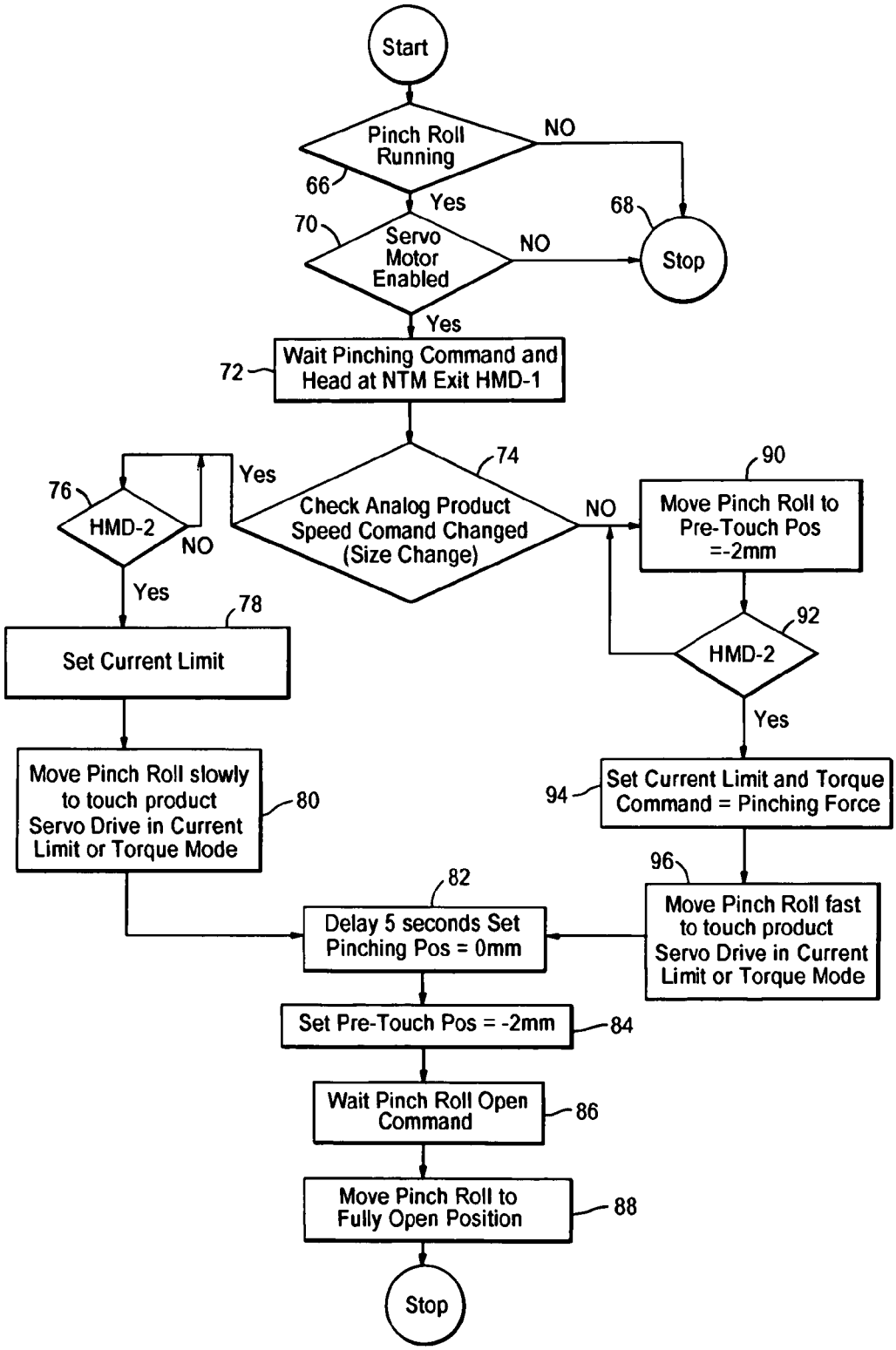
FIG. 5 is a flow-chart describing a typical pinching sequence.

FIG. 5 depicts the process of controlling a front end pinch sequence for one of the pinch roll units. The process begins by determining whether motor 56 is operating to drive the pinch rolls 34 (Step 66). If the pinch rolls are not being driven, the process is aborted (Step 68). If the pinch rolls are being driven, the system then determines if the servo motor 36 has been enabled (Step 70). If the servo motor has not been enabled, the process is aborted. If the servo motor is enabled, the system then awaits a pinching command (Step 72) to be supplied by the PLC in response to a front end presence signal 60 received from the hot metal detector HMD-1. Based on an analysis of the product speed signal 58, the system then determines whether the product size has changed (Step 74). If the product size has changed, the system awaits the arrival of the front end at HMD-2 (Step 76). Upon arrival of the front end at that location, the system sets the current limit for the servo motor 36 (Step 78), which determines the maximum pinch pressure to be applied to the product by the pinch rolls 34. The servo motor is then operated to slowly move the pinch rolls 34 into contact with the product and to increase the current to the preset limit (Step 80). After a prescribed delay, e.g., 5 seconds (Step 82), the system determines a pre-touch position for the pinch rolls (Step 84), which is a short distance from contact with the product surface, e.g., 2 mm from contact. The system then awaits an open command from the mill control system (Step 86), before signaling the servo motor to move the pinch rolls to their fully open positions (Step 88).

If the product size has not changed (Step 74), the system then moves the pinch rolls to the previously determined pre-touch position (Step 90). The system then awaits the arrival of the front end at HMD-2 (Step 92), after which the current limit for the servo motor 36 is set (Step 94), and the servo motor is energized to rapidly move the pinch rolls 34 from their pre-touch position into contact with the product followed by a current increase to the preset limit (Step 96). The system then cycles through the remainder of steps 84 to 88.

It will be understood by those skilled in the art that the similar routines are provided for pinching the tail ends of products, or when circumstances dictate, for pinching the entire product length.

The present invention provides numerous advantages over pneumatically actuated pinch roll units and control systems currently being employed. For example, the fast reaction times of the servo motors 36 makes it possible to locate the HMD-2 detectors close to the pinch roll units and to pinch the product within a meter of the head end passing through the pinch roll units. By contrast, when employing the slower reacting pneumatically actuated systems, the hot metal detectors must be positioned well in advance of the pinch roll units, usually before the finishing block 10. The torque limiting capabilities of the servo motors 36 and the speed controls of the drive motors 56 can be electronically coupled to properly balance pinch roll torque and pinching force during product acceleration and deceleration, thus avoiding surface marking of the product, Pre-touch positions of the pinch rolls can be memorized and used repeatedly for the same product sizes The electrically driven system for effecting pinching sequences is more rigid than the conventional pneumatically controlled systems, which, because of the compressibility of air, suffer from uncontrollable variations in pinching force as product dimensions change.

We claim:

1. A pinch roll unit for either propelling or retarding a product moving along the pass line of a rolling mill, said pinch roll unit comprising:

a pair of levers mounted for rotation about parallel first axes;

roll shafts carried by said levers, each roll shaft being journalled for rotation about a second axis parallel to the first axis of its respective lever;

pinch rolls carried by said roll shafts, said pinch rolls defining a gap therebetween for receiving said product;

an electrically powered first motor;

linkage means for mechanically coupling said first motor to said levers, said first motor being operable via said linkage means to rotate said levers about said first axes and to move said pinch rolls between open positions spaced from said product, and close positions contacting and gripping said product therebetween; and an electrically powered second motor for rotatably driving said pinch rolls.

2. The pinch roll unit of claim 1 wherein said linkage means comprises a disc crank driven by said first motor for rotation about a third axis parallel to said first and second axes, and a pair of link members, each link member being pivotally coupled at opposite ends to said disc crank and to a respective one of said levers.

3. The pinch roll unit of claim 1 or 2 further comprising detector means for generating a signal indicative of the presence of said product at a location along said pass line preceding the gap defined between said pinch rolls, and control means responsive to said signal for operating said first motor to move said pinch rolls between said open and closed positions by rotating said levers about said first axes.

4. The pinch roll unit of claim 3 wherein said control means is additionally operative to control the pressure exerted by said pinch rolls on the product.

5. The pinch roll unit of claim 4 wherein the pressure exerted by the pinch rolls on the product is controlled by varying the torque exerted by said first motor.

6. The pinch roll unit of claim 4 wherein said control means is additionally operative to control the speed at which said pinch rolls are driven by said second motor.

7. The pinch roll unit of claim 3 wherein said control means is additionally operative for a given product size, to determine a pre-touch position for said pinch rolls between said open and closed positions, and to memorize said pre-touch position for subsequent reuse with products of the same size.

8. The pinch roll unit of claim 7 wherein said control means is additionally operative to change said pre-touch position in response to changes in said product size.

9. The pinch roll unit of claim 1 wherein said first motor is a servo motor.

10. In a rolling mill in which hot rolled products are directed along a pass line between pinch rolls, and the pinch rolls are opened and closed by an electrically powered servo motor, a method of controlling the operation of said pinch rolls, said method comprising:

(1) detecting the arrival and speed of a product at a location along the pass line in advance of said pinch rolls;

(2) based on the results of step (1), determining whether the product size has changed from a preceding size to a new size;

(3) based on the results of step (2):

(a) if the product size has changed:

(i) setting the current limit to be applied to the servo motor to achieve a predetermined pinch roll pressure on the product;

(ii) energizing the servo motor to move the pinch rolls slowly from fully open positions to closed positions in contact with the product to effect said predetermined pinch roll pressure;

(iii) determining and storing an interim setting for the servo motor at which the pinch rolls are moved from, said fully open positions to pre-touch positions spaced a short distance from the product; or (b) if the product size has not changed:

(i) energizing the servo motor in accordance with a previously stored interim setting to move the pinch rolls rapidly from said fully open positions to the resulting pre-touch positions;

(ii) setting the current limit to be applied to the servo motor to achieve a predetermined pinch roll pressure on the product;

(iii) moving the pinch rolls slowly from the pre-touch positions into contact with the product to effect said predetermined pinch roll pressure on the product;

(iv) determining and storing an updated interim setting for the servo motor;

(4) awaiting a pinch roll open command; and (5) energizing the servo motor to return the pinch rolls to their fully open positions.

* * * * *